United States Patent [19]

Runnels et al.

[11] 4,227,035

[45] Oct. 7, 1980

[54] MODULAR CONDENSER BUSHING

[75] Inventors: Robert W. Runnels; Loren B. Wagenaar, both of Muncie, Ind.

[73] Assignee: Westinghouse Electric Corp., Pittsburgh, Pa.

[21] Appl. No.: 905,673

[22] Filed: May 15, 1978

[51] Int. Cl.[3] ..... H01B 17/28

[52] U.S. Cl. ..... 174/15 BH; 174/31 R; 174/143

[58] Field of Search ..... 174/15 BH, 16 BH, 31 R, 174/73 R, 73 SC, 143; 361/302, 328, 329, 330

[56] References Cited

U.S. PATENT DOCUMENTS

| | | | |
|---|---|---|---|
| 2,650,334 | 8/1953 | Skeats | 174/143 X |
| 2,852,596 | 9/1958 | Prince | 174/73 R |
| 3,394,455 | 7/1968 | Grimmer | 174/143 X |
| 3,462,545 | 8/1969 | Grimmer | 174/143 |
| 3,584,131 | 6/1971 | Allmendinger | 174/143 X |
| 3,588,319 | 6/1971 | Isogai et al. | 174/143 |
| 3,627,906 | 12/1971 | Kurz et al. | 174/143 |
| 3,659,033 | 4/1972 | Grimmer | 174/15 BH |
| 3,692,928 | 9/1972 | Friedrich | 174/143 |
| 3,793,477 | 2/1974 | Wagenaar | 174/143 |

FOREIGN PATENT DOCUMENTS

| | | | |
|---|---|---|---|
| 431367 | 7/1926 | Fed. Rep. of Germany | 174/31 R |
| 903230 | 2/1954 | Fed. Rep. of Germany | 174/143 |
| 1640847 | 7/1973 | Fed. Rep. of Germany | 174/143 |
| 1124775 | 7/1956 | France | 174/143 |
| 478839 | 3/1953 | Italy | 174/143 |
| 364839 | 1/1932 | United Kingdom | 174/143 |

OTHER PUBLICATIONS

Isogai, T., et al., "Epoxy-Resin-Impregnated Paper Insulation System for Ultra-High-Voltage Applications," *IEEE Transactions on Electrical Insulation,* vol. EI-6, No. 2, Jun. 1971, pp. 94-100.

*Primary Examiner*—Laramie E. Askin
*Attorney, Agent, or Firm*—D. R. Lackey

[57] ABSTRACT

Electrical bushing having a plurality of individual condenser modules coaxially enclosing an electrical conductor. The condenser modules are spaced apart to define a gap therebetween. Each condenser module includes a plurality of concentric, axially extending, electrically conductive layers. The axial spacing between the ends of corresponding conductive layers in adjacent, coaxial condenser modules is varied across the condenser modules in order to control the voltage gradient across the gap between the condenser modules and to provide uniform capacitance across the bushing.

7 Claims, 8 Drawing Figures

MODULAR CONDENSER BUSHING

BACKGROUND OF THE INVENTION

1. Field of the Invention

This invention relates, in general, to electrical bushings and, more specifically, to electrical bushings having condenser structures.

2. Description of the Prior Art

Recent developments in power transmission have resulted in systems employing voltages in excess of 765 KV. Accordingly, the power transmission equipment, such as transformers, must increase in capacity and size to handle the extra high voltages. In addition, condenser type electrical bushings normally associated with power transformers must also increase in size and, more particularly, in length. However, the effective use of condenser structures in bushings designed for extremely high voltages presents several problems relating to design and manufacturing techniques uncommon with lower voltage bushings.

In condenser-type electrical bushings, a plurality of electrically conducting layers surround the conductor to distribute the voltage equally across the bushing. However, as the bushing increases in size, it becomes increasingly difficult to provide uniform capacitance between adjacent layers.

Split-foil or axially-divided capacitive layers have been utilized in U.S. Pat. Nos. 3,462,545, 3,627,906, 3,659,033 and 3,793,477, all assigned to the assignee of the present application, to provide uniform capacitance and minimize radial build of the condenser sections. However, this method of voltage control has a length limitation due to increasing voltage gradients with length. There are also manufacturing restrictions on condenser size due to factors such as the width of the insulating paper, and the diameters and lengths of winding machinery. In particular, the restrictions on the maximum available width of insulating paper used to form the condenser necessitates the use of a time consuming spiral winding process to wrap the paper around the conductor when the maximum paper width is exceeded.

Another method of providing voltage control that overcomes many of the problems associated with the split-foil type condenser structures utilizes a so-called modular condenser; that is, a condenser constructed of several smaller sections or modules which are manufactured individually and assembled together to form the complete condenser assembly. For the modular condenser to be effective, however, the voltage gradients across the gap between adjacent modules must be controlled. One method of controlling voltage gradients across the gap is shown in U.S. Pat. No. 3,588,319, issued to T. Isogai et al., in which the gap between opposing modules is disposed at a predetermined angle with respect to the axis of the conductor. In addition, the conductive layers in the condenser module whose face forms an obtuse angle with respect to the axis of the conductor are placed nearer the conductor than the conductive layers in the opposing module so that the equipotential lines between the conductive layers in the two modules intersect the gap at right angles to thereby increase the creepage distance along the gap. However, the different radial spacing of the conductive layers in the adjoining modules may result in regions of high voltage gradients in the condenser.

Thus, it is desirable to provide a condenser bushing in which the individual condenser modules are effectively arranged to provide uniform capacitance across the bushing without producing regions of high voltage gradient concentration. It is also desirable to provide a condenser bushing having individual condenser modules in which a high degree of voltage control is maintained across the gap between adjacent modules. It is also desirable to provide a condenser bushing for use in high voltage applications which can be manufactured by existing equipment and, further, which can use the more economical sheet winding process to wrap the paper insulation around the conductor instead of the time consuming spiral winding method.

SUMMARY OF THE INVENTION

Herein disclosed is an electrical bushing having improved modular condenser structures which distribute the voltage uniformly across the bushing and, further, conveniently control the voltage gradients across the gap between adjacent modules. The condenser modules are coaxially disposed around the electrical conductor with adjacent ends spaced apart to form a gap or clearance therebetween. Each condenser element includes a plurality of concentric, axially extending, electrically conductive layers.

High voltage gradient concentrations within the condenser modules are avoided by varying the axial spacing between corresponding conductive layers in adjacent condenser modules incrementally across the modules. In one embodiment, the conductive layers extend completely through one of the condenser modules to be in proximity with the end surface of the module which forms the gap; while the axial length of the conductive layers in the adjacent module are incrementally varied from the end surface at the gap so as to be progressively spaced from the corresponding conductive layers in the adjacent condenser module. In another embodiment, the conductive layers extend through each condenser module so as to be disposed in proximity with the end surface which forms the gap. In this embodiment, the axial width of the gap is varied in a radial direction with an additional insulative member being disposed within the gap to provide the aforementioned voltage control. In both embodiments, the conductive layers may be coaxially aligned with corresponding conductive layers in the adjacent condenser module to provide uniform capacitance across the entire bushing.

In addition, the improved modular condenser structures disclosed herein control the voltage gradient across the gap between adjacent coaxial modules by disposing the end surface of the condenser module having the conductive layers disposed in proximity with the end surface forming the gap at a predetermined angle with respect to the conductor axis. The angle is determined in conjunction with the ratio of the dielectric constants of the insulating materials in the gap and the condenser modules such that the equipotential lines extending between corresponding conductive layers in adjacent modules will bend radially outward from the conductor upon entering the gap which prevents voltage concentrations within the gap or in the condenser modules.

The improved condenser structures disclosed herein enable a bushing to be constructed with individual condenser elements in which the voltage is distributed uniformly across the bushing and concentrations of voltage gradients within the gap between adjacent condenser modules or at any point in the bushing are eliminated. In addition, the condenser elements may be constructed on existing manufacturing equipment and, further, may be formed by the more economical sheet winding process instead of the time consuming spiral wrapping method.

BRIEF DESCRIPTION OF THE DRAWINGS

The various features, advantages and other uses of this invention will become more apparent by referring to the following detailed description and the accompanying drawings, in which.

DESCRIPTION OF THE PREFERRED EMBODIMENTS

Throughout the following description, identical reference numbers are used to refer to the same component shown in all Figures of the drawings.

Figure 1:
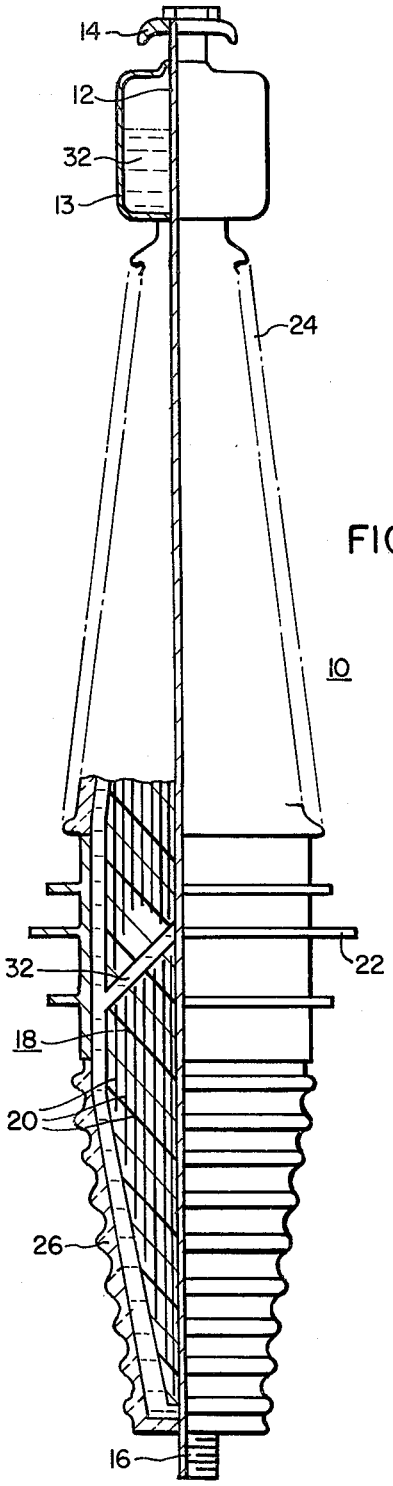
FIG. 1 is an elevational view, partially in section, of a condenser bushing which may utilize the teachings of this invention.

Referring now to the drawings, and to FIG. 1 in particular, there is shown a condenser bushing 10 which may utilize the teachings of this invention. The bushing 10, which may be used with power transformers or power circuit breakers, has a generally elongated shape and includes a centrally or axially disposed electrical conductor 12, which is constructed of a conductive material, such as copper, steel or aluminum. The electrical conductor 12 is terminated at its upper end by an expansion cap 13 and a suitable terminal cap assembly 14, which is adapted for connection to an external electrical conductor; and at its bottom end by terminal means 16, which is adapted for connection to the associated electrical apparatus. The electrical conductor 12 has an insulating or condenser section 18 disposed thereon, which may be formed of layers of insulating material, such as paper, having a plurality of spaced metallic foil sheets 20 disposed therein to form cylindrical capacitor plates to grade the radial and longitudinal voltage distribution in the bushing. The insulating or condenser section 18 may be formed by winding a high quality paper on the electrical conductor 12 while the paper is under a predetermined uniform tension, and feeding metallic foil sheets or capacitor plates at predetermined intervals to provide a plurality of serially connected capacitors. Since it is desirable to uniformly grade the radial voltage across the condenser section 18, the capacitance of each section may be constructed to be equal. For example, as the diameters of the capacitor plates 20 increase, the longitudinal length of the plates may decrease in order to maintain substantially the same surface area. The graduated length of the foil layers 20 provides graded voltage longitudinally or axially along the length of the bushing 10. The condenser section 18 is oil impregnated to fill all the voids in the structure and thereby prevent the formation of corona discharges therein, to provide a minimum power factor and thus reduce dielectric heating of the structure, and in certain gradings it includes one or more ducts for circulation of the oil to remove heat from the condenser section.

A grounded metallic flange 22 is disposed intermediate the ends of the bushing 10 and adjacent to the condenser section 18 to provide means for attaching the bushing 10 to a metallic transformer or circuit breaker casing, not shown. Shell-like insulating members 24 and 26, which may be constructed of an electrical grade of porcelain having a glazed, corrugated outer surface for providing additional creep distance, or of a suitable resin, such as an epoxy resin, are disposed between the flange 22 and the upper terminal 14, and between the flange 22 and the bottom terminal 16, respectively. Shell members 24 and 26 provide weatherproof insulating means between the ends of the bushing and the grounded flange 22, and also provide a container for the insulating and cooling fluid 32, such as mineral oil, frequently used.

While the bushing 10 has been described as having a capacitor section formed of layers of paper interspersed with radially spaced layers of electrically conductive material to provide capacitor plates, it is to be understood that the condenser section 18 may be constructed in any other suitable manner, such as by winding the capacitor section with resin impregnated paper, such as epoxy resin, adding sheets of foil as required, or by placing the capacitor plates in a mold and introducing a liquid resinous insulation system thereto, such as an epoxy or polyester resin, which resin system is substantially cured to a solid mass. In the latter instance, the entire insulating structure of the bushing, including the weather sheds, may be formed of the cast resin. Further, while the capacitor plates are broadly termed electrically conductive, it is to be understood that they may be formed of sheets, foils or coatings of a good electrical conductor, such as copper or aluminum. They may be sheets or coatings of partially conductive material, such as those containing carbon, or they may be sheets or coatings of semiconductive material, i.e., material having a distinct voltage dependent resistivity, such as those containing silicon carbide.

The above-described bushing 10 may be used in a variety of applications in which the upper terminal assembly 14 and the lower terminal means 16 are disposed in many different insulating environments to include oil, gas, such as sulphur hexafluoride ($SF_6$), or air. Furthermore, in applications where the lower portion of the bushing is disposed within a fluid-filled electrical apparatus, such as a transformer, the lower housing 26 may be eliminated altogether without departing from the teachings of this invention.

Figure 2B:
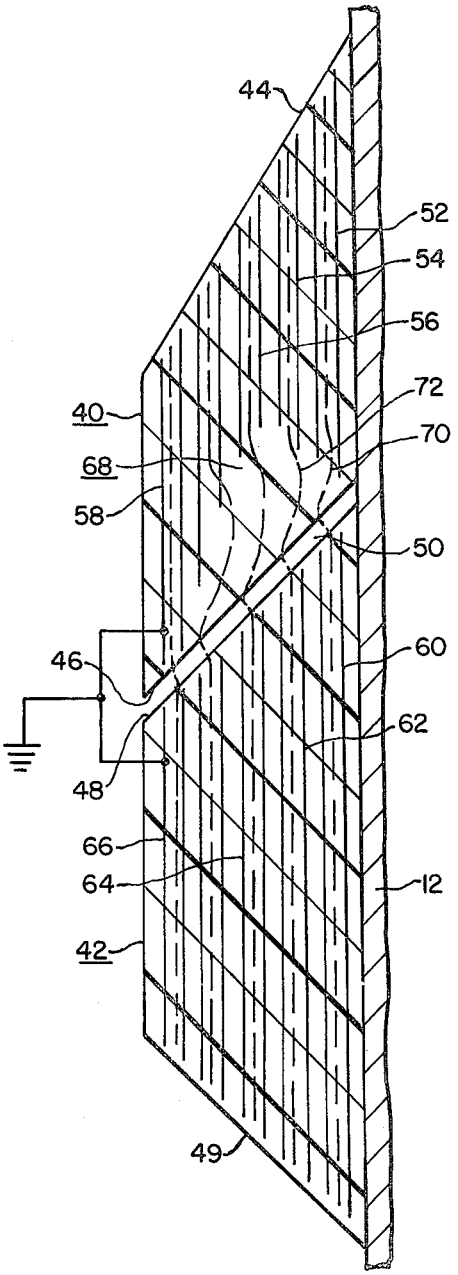
FIGS. 2A and 2B are partial, diagrammatic representations of a condenser structure constructed according to the teachings of this invention, which may be used with the condenser bushing shown in FIG. 1.
Figure 2A:
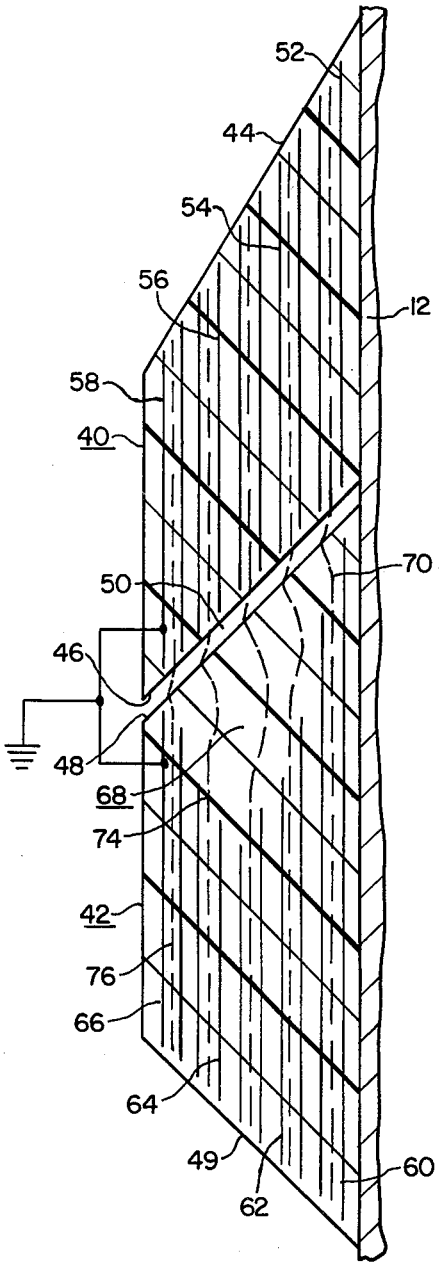

Referring now to FIG. 2A, there is shown a modular condenser structure constructed according to the teachings of this invention. As shown therein, the modular condenser structure includes first and second insulating condenser elements or modules 40 and 42, respectively. The first and second condenser elements 40 and 42, which have a substantially cylindrical shape and approximately the same diameter, are coaxially disposed around the conductor 12. Each condenser module 40 and 42 has first and second end surfaces, such as end surfaces 44 and 46 for the first condenser element 40 and end surfaces 48 and 49 for the second condenser element 42, which have a generally tapered shape in order to provide equal capacitance across the bushing as described previously. The first and second condenser modules 40 and 42 are spaced apart such that the adjacent end surfaces 46 and 48 define a gap or clearance 50 between the two condenser modules 40 and 42.

A plurality of radially spaced, axially extending, electrically conductive layers are disposed in each of the condenser modules 40 and 42. These layers, such as layers 52, 54, 56 and 58 in condenser module 40 and layers 60, 62, 64 and 66 in condenser module 42 provide series capacitance between the conductor 12 and the grounded metallic flange 22 of the bushing 10 which uniformly distributes the voltage radially across the bushing 10.

For a modular condenser to be effective, the voltage gradient across the gap 50 between adjacent modular condensers, such as condensers 40 and 42, must be controlled in order to prevent concentration of voltage gradients at any one point within the gap or the condenser modules.

According to the preferred embodiment of this invention, control of the voltage gradients across the gap 50 is achieved by varying the spacing between the adjacent ends of the layers in the first and second condenser modules 40 and 42. Thus, in the first condenser module 40, the conductive layers, such as layers 52, 54, 56, 58, extend the entire axial length of the condenser module 40 so as to be disposed in proximity with the end surface 46 at the gap 50. In the second condenser module 42, the conductive layers 60, 62, 64 and 66 have a varying length across the width of the condenser module 42. Thus, the innermost and outermost conductive layers 60 and 66, respectively, extend substantially all of the way through the length of the condenser module 42 so as to be in proximity with the end surface 48 at the gap 50. The axial length of the intermediate conductive layers, such as conductive layers 62 and 64, is varied such that the ends of the conductive layers 62 and 64 are incrementally spaced from the corresponding conductive layers 54 and 56 in the adjacent condenser module 40 whereby an additional gap or space 68 is formed between the ends of the intermediate conductive layers, such as layers 62 and 64, and the end surface 48 at the gap 50.

When an electrical potential is applied to the bushing 10, equipotential lines will extend between corresponding conductive layers, such as equipotential line 70 extending between conductive layers 52 and 60 in the first and second condenser modules 40 and 42, respectively, and equipotential line 74 extending between conductive layers 56 and 64 in the condenser modules 40 and 42. For a modular condenser structure to be effective, the voltage gradient across the gap between adjacent modules must be controlled; otherwise the equipotential lines will bend toward the conductor upon entering the gap which thereby results in a concentration or crowding of the equipotential lines near the conductor and causes an undesirable high voltage concentration at that point.

This invention proposes to control the voltage gradient across the gap between adjacent condenser modules by constructing the modules such that the end surface of one of the modules, which has the conductive layers disposed in proximity with said end surface, is at a predetermined angle with respect to the axis of the conductor. The angle, whether obtuse or acute, is determined in conjunction with the ratio of the dielectric constants of the insulating materials in the gap and the condenser modules to insure that the equipotential lines, upon entering the gap, bend radially outward from the conductor.

Thus, the condenser module 40, in FIG. 2A, which has the conductive layers 52, 54, 56 and 58 disposed in proximity with the end surface 46 at the gap 50, has its end surface 46 disposed at an acute angle, less than 90°, with respect to the axis of the conductor 12, with small angles being the most desirable. The insulating material disposed within the gap 50, which may be a solid material or a coolant fluid, is selected to have a lower dielectric constant than the dielectric constant of the material used to construct the condenser modules 40 and 42. Since paper, having a dielectric constant of about 3.5, is normally used to form the condenser modules 40 and 42; an insulating material, such as oil which has a dielectric constant of 2.2, or a solid insulating material having a dielectric constant less than 3.5, may be used.

As the equipotential lines, such as lines 70 and 74, enter the gap 50, they will bend radially outward from the conductor 12, in a manner analogous to the refraction of light entering a lens, which thereby provides control of the voltage gradient across the gap 50 by increasing the creepage distance along the gap 50 and prevents any concentration of voltage gradients within the gap 50 or either condenser module 40 or 42.

In the structure shown in FIG. 2A, it is important that the condenser module, having an end surface at the gap which is disposed at an acute angle with respect to the axis of the conductor 12, have the conductive layers disposed in proximity with the end surface adjacent the gap 50. Otherwise, voltage control across the gap 50 will be hindered since the equipotential lines extending across the gap 50 will be bent radially inward towards the conductor 12 thereby resulting in a concentration or crowding of the equipotential lines near the conductor 12.

Referring now to FIG. 2B, there is shown another modular condenser structure which provides voltage control across the gap 50. The modular condenser shown therein is identical to that shown in FIG. 2A with the exception that the end surface 48 of the module 42, which has the conductive layers disposed in proximity with the gap 50, is disposed at an obtuse angle, greater than 90°, with respect to the axis of the conductor 12. In this embodiment, the insulating material disposed within the gap 50 is selected to have a dielectric constant greater than that of the material in the condenser modules 40 and 42. Thus, if epoxy resin, for example, which has a dielectric constant of about 5.5, is disposed within the gap 50, the equipotential lines extending between corresponding conductive layers in modules 40 and 42, will, upon entering the gap 50, also bend radially outward from the conductor 12 to again provide the desired voltage control across the gap 50.

Referring now to FIGS. 3 through 7, there are shown other modular condenser structures constructed according to the teachings of this invention. Although FIGS. 3 through 7 are illustrated as being similar to the structure shown in FIG. 2B, in that the end surface of the module having conductive layers disposed in proximity therewith is at an obtuse angle with respect to the axis of the conductor 12 and the dielectric constant of the insulating material within the gap is greater than that of the material used to form the modules, it will be understood that the structures shown therein may be formed similar to that depicted in FIG. 2A with an acute angle formed between said end surface and the conductor. The condenser structure shown in FIG. 3 consists of first and second condenser modules 80 and 82 which are constructed in an identical manner to the condenser modules 40 and 42 shown in FIG. 2B, in that the conductive layers within the first module 80, whose end surface at the gap 86 forms an obtuse angle with respect to the axis of the conductor 12, extend the entire axial length of the module 80; while the conductive layers in the adjacent condenser module 82 are incrementally spaced from the end surface which forms the gap 86. A third condenser module 84 is wrapped around the first and second condenser modules 80 and 82 and includes a plurality of radially spaced, electrically conductive layers extending the entire axial length thereof.

The gap 86 between adjacent condenser modules 80 and 82 may also be used as an oil duct to provide coolant flow past the central conductor 12 and between the condenser sections. In this configuration, at least one of the condenser modules, such as condenser module 82, is spaced from the conductor 12 to form a duct 88 therebetween. Any suitable means for forming the duct 88 may be used, such as having a layer of insulative material 90 spaced from the conductor 12 and supporting the condenser module 82 or using grooves in the outer surface of the conductor 12 to provide a fluid flow path. The duct 88 is disposed in fluid communication with the gap 86 between the adjacent condenser modules 80 and 82 and with a similar duct 92 formed between the condenser modules 80 and 82 and the condenser module 84 wherein fluid coolant, such as mineral oil, may be disposed to cool and insulate the conductor 12 and the condenser modules 80, 82 and 84. The innermost conductive layer 94 in the condenser module 82 may be connected to the lead 12 to avoid a voltage across the duct 88. Similarly, the outermost conductive layers 96 and 98 in the condenser modules 80 and 82 may be joined to the innermost conductive layer 100 in the condenser module 84 to avoid a voltage across the duct 92 formed therebetween.

Figure 4:
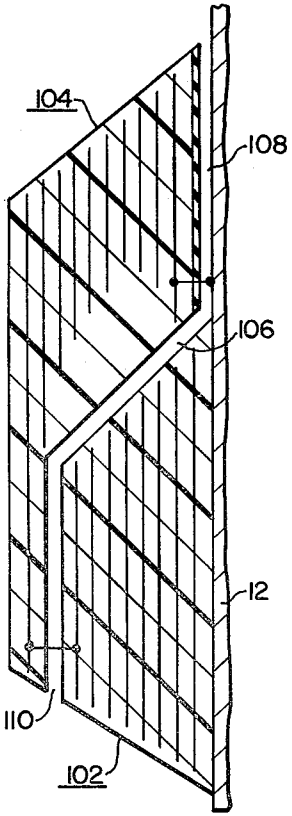
FIG. 4 is a diagrammatic representation of another condenser structure suitable for use in the bushing of FIG. 1.
Figure 3:
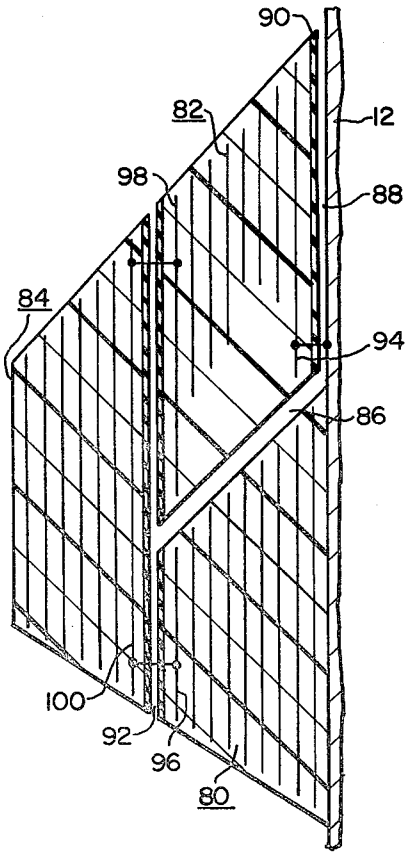
FIG. 3 is a diagrammatic representation of another condenser structure suitable for use in the bushing of FIG. 1.

FIG. 4 depicts yet another embodiment of a condenser structure constructed according to the teachings of this invention. The condenser modules 102 and 104, which are axially disposed around the conductor 12, have different diameters such that a portion of the condenser module 104 surrounds the outermost conductive layers of condenser module 102. The conductive layers in the condenser modules 102 and 104 are disposed in the same manner as those shown in FIG. 2B to provide voltage control across the gap 106 situated therebetween. In addition, ducts 108 and 110 are formed between the second condenser module 104 and the conductor 12 and also between the portion of the second condenser module 104 which surrounds the first condenser module 102 and the first condenser module 102 to provide a fluid flow path for coolant flow past the conductor 12 and the condenser modules 102 and 104.

Figure 6:
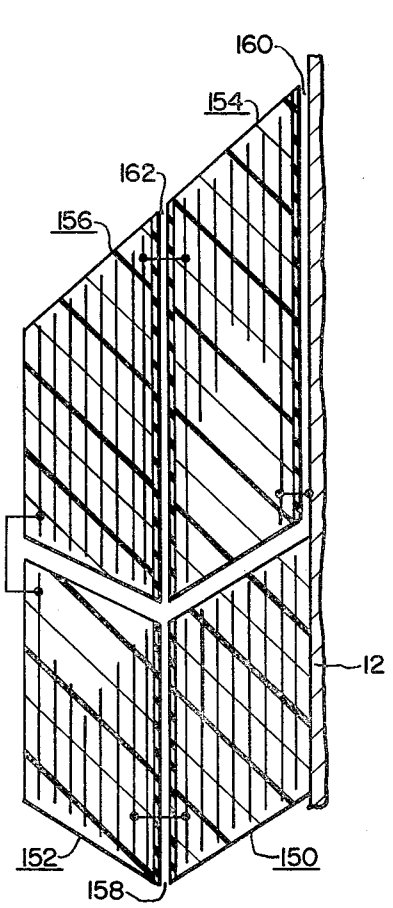
FIG. 6 is another embodiment of the condenser structure shown in FIG. 5.
Figure 5:
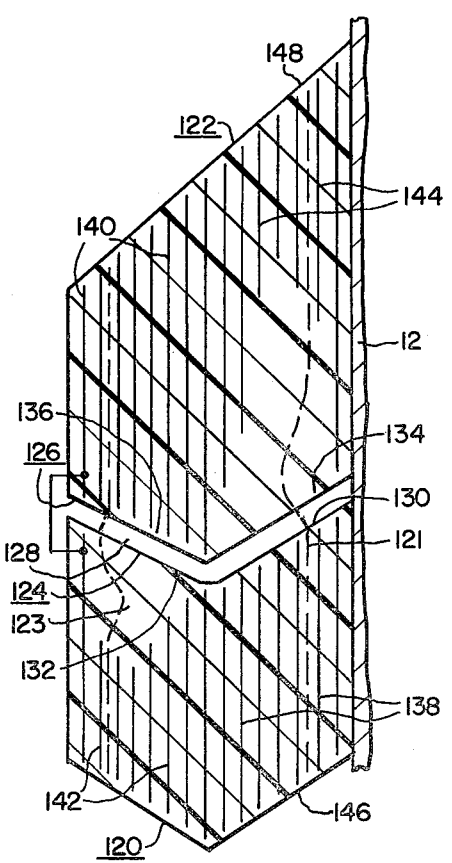
FIG. 5 is a diagrammatic representation of another condenser structure suitable for use in the bushing of FIG. 1.

Referring now to FIGS. 5 and 6, there is shown condensers using so-called "re-entrant" modules constructed according to the teachings of this invention. In a "re-entrant" type of condenser, one or both of the outer end surfaces, such as end surface 146 of condenser module 120, has a substantially V-shaped cross-sectional configuration, which reduces the required width of paper insulation used to form the condenser modules.

Although only the condensers illustrated in FIGS. 5 and 6 are shown as having one "re-entrant" end surface, it will be understood that both end surfaces may be "re-entrant" and, further, the condenser modules illustrated in FIGS. 2A, 2B, 3, 4 and 7 may also have one or both outer end surfaces shaped in a "re-entrant" or V-shaped cross-sectional configuration such as, for example, end surface 44 of condenser module 40 in FIG. 2A.

The condenser bushing structure shown in FIG. 5 includes first and second condenser modules 120 and 122 which are axially disposed around the conductor 12. The condenser modules 120 and 122 have end surfaces 124 and 126, respectively, which are spaced apart to form a gap or clearance 128 therebetween. Each of the end surfaces of the condenser modules 120 and 122 which are adjacent the gap 128 are divided into two portions, such as first and second portions 130 and 132 for the end surface 124 of condenser module 120 and first and second portions 134 and 136 of the end surface 126 of the condenser module 122. In order to provide the desired voltage control along the gap 128, the first portion 130 of the end surface 124 is disposed at an obtuse angle with respect to the conductor 12 and the second portion 132 at an acute angle with respect to the conductor 12; while the first portion 134 of the end surface 126 is disposed at an acute angle and the second portion 136 is disposed at an obtuse angle with respect to the conductor 12. The conductive layers in the condenser modules 120 and 122 are disposed in a manner similar to that shown in FIG. 2B. Accordingly, the conductive layers 138 in the condenser module 120 and the conductive layers 140 in the condenser module 122 are disposed in proximity with the portions of the end surfaces thereof at the gap 128 which are disposed at obtuse angles with respect to the axis of the conductor 12. On the other hand, the conductive layers 142 in the first conductor module 120 and conductive layers 144 in the second condenser module 122 are incrementally spaced from the end surfaces at the gap 128 which are disposed at acute angles with respect to the axis of the central conductor 12. The condenser bushing structure shown in FIG. 5 operates in an identical manner to that shown in FIG. 2B in that the equipotential lines, such as lines 121 and 123, extending between corresponding conductive layers in the first and second portions of each condenser module 120 and 122 are bent radially outward from the conductor 12 to provide the necessary voltage control across the gap 128.

The condenser bushing structure shown in FIG. 6 is identical to that shown in FIG. 5 with the exception that each condenser module 120 and 122 shown in FIG. 5 is divided into two portions which, when viewed as a whole, function identically to the entire condenser modules 120 and 122 described above. Thus, it can be seen that condenser modules 150 and 152 have substantially the same shape as condenser module 120 shown in FIG. 5 with the addition of a coolant duct 158 therebetween. Condenser modules 154 and 156 taken as a unit are similar to condenser module 122 shown in FIG. 5 with coolant ducts 160 and 162 disposed for coolant flow.

Figure 7:
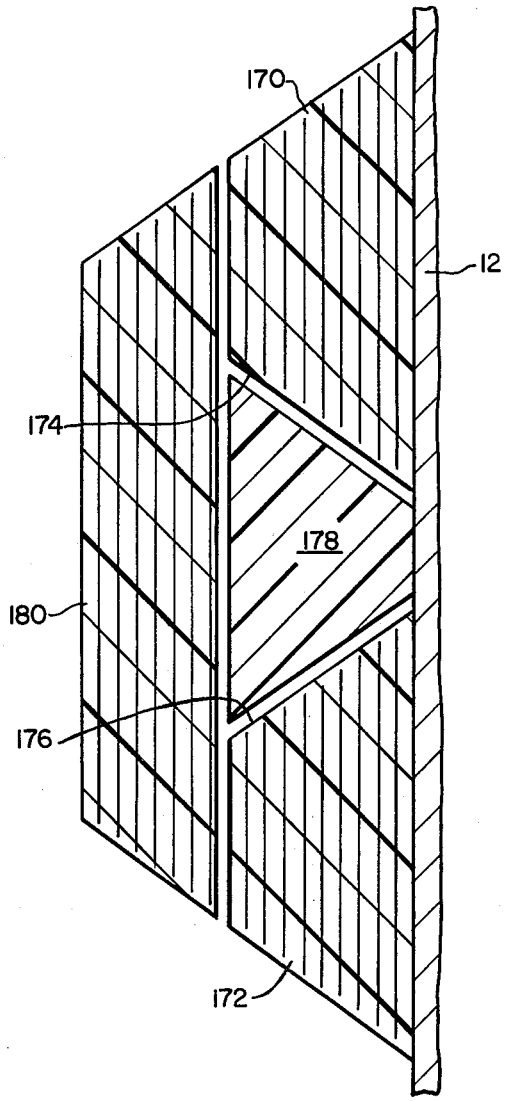
FIG. 7 is a partial diagrammatic representation of another condenser structure suitable for use in the bushing of FIG. 1.

There is shown in FIG. 7 another embodiment of a condenser structure constructed according to the teachings of this invention. Condenser modules 170 and 172 are coaxially disposed around the conductor 12 and include a plurality of radially spaced, electrically conductive layers which extend completely through the axial length of the respective condenser modules 170 and 172. The adjacent end surfaces 174 and 176 of the condenser modules 170 and 172 are spaced apart to form a gap wherein a member 178, formed of electrically insulating material, such as one sold commercially under the trade name "MICARTA", is disposed. A third module 180 is disposed around modules 170 and 172 to electrically connect the outermost conductive layers in modules 170 and 172 and thereby provide uniform capacitance across the bushing.

Control of the voltage gradients across the gap formed between the adjacent condenser modules 170 and 172 is obtained by disposing the end surfaces 174 and 176 at obtuse angles with respect to the axis of the conductor 12 such that the width of the gap formed therebetween increases radially across the width of the condenser section. Thus, the spacing between the adjacent ends of corresponding conductive layers in the condenser modules 170 and 172 varies across the width of the condenser in a manner similar to that described previously with respect to FIG. 2B. In operation, the equipotential lines extending between corresponding conductive layers in the first and second condenser modules 170 and 172 will be bent radially outward as they enter the gap at the respective end surfaces 174 and 176. This eliminates the crowding of the equipotential lines near the surface of a conductor and thereby avoids any concentration of voltage gradients within the condenser modules 170 and 172.

It will be apparent to one skilled in the art that there has been herein disclosed an electrical bushing having improved modular condenser elements which uniformly distribute the voltage across the bushing and, further, control the voltage gradients across the gap between adjacent, coaxial modules. By varying the axial spacing between the adjacent ends of corresponding conductive layers in the coaxial condenser modules, the concentration of voltage gradients within the gap and within each module is avoided and the creepage distance along the gap is increased. The modular condenser structures disclosed herein may also be constructed on existing manufacturing equipment and, further, enable the use of the more economical sheet winding method to wrap the paper insulation around the conductor instead of the time consuming spiral wrapping process.

We claim:

1. An electrical condenser bushing comprising:

an axially extending electrical conductor; and first and second condenser elements each formed of concentric axially extending electrically conductive layers separated by like electrical insulating material having a predetermined dielectric constant, said first and second condenser elements being coaxially disposed around said conductor and axially spaced apart to define a gap of predetermined width between adjacent end portions thereof, said gap being filled with an electrically insulating material having a predetermined dielectric constant, which dielectric constant is different than the dielectric constant of the electrically insulating material of said first and second condenser elements;

said electrically conductive layers in each of said first and second condenser elements having predetermined electrical potentials when said electrical conductor is energized, forming equipotential lines between their adjacent end portions;

the ends of the conductive layers in the first condenser element being axially spaced in varying increments from the end portion of said first condenser element which is adjacent to the gap, to define a conductive layer free space;

the ends of the conductive layers in the second condenser element being disposed in proximity with the end portion of said second condenser element which is adjacent to the gap;

the end portion of said second condenser element which is adjacent to an end portion of the first condenser element being disposed at a predetermined angle with respect to the axis of the conductor, said angle and the ratio of the dielectric constant of the insulating material in said gap to the dielectric constant of the insulating material forming said first and second condenser element being selected to cause the equipotential lines extending from said conductive layers in said second condenser element to the conductive layers at substantially the same potential in said first condenser element to bend radially outward with respect to the axis of said conductor upon entering said gap.

2. The electrical condenser bushing of claim 1 wherein the electrically conductive layers in the first condenser element are substantially coaxially aligned with the electrically conductive layers at substantially the same potential in the second condenser element.

3. The electrical condenser bushing of claim 1 wherein:

the end portion of the second condenser element forming the gap is disposed at an obtuse angle with respect to the axis of the conductor; and the dielectric constant of the insulating material in said gap is greater than the dielectric constant of the insulating material forming the first and second condenser elements.

4. The electrical condenser bushing of claim 1 wherein:

the end portion of the second condenser element forming the gap is disposed at an acute angle with respect to the axis of the conductor; and the dielectric constant of the insulating material in said gap is less than the dielectric constant of the insulating material forming the first and second condenser elements.

5. The electrical condenser bushing of claim 1 wherein the conductive layers in the second condenser element extend substantially completely through said second condenser element.

6. The electrical condenser bushing of claim 1 further including:

means for forming a fluid flow path between at least one of the first and second condenser elements and the conductor, said fluid flow path being disposed in fluid communication with the gap between adjacent end portions of said first and second condenser elements; and a dielectric fluid disposed in said fluid flow path and said gap between adjacent end portions of said first and second condenser elements to cool and electrically insulate said conductor and said first and second condenser elements.

7. An electrical condenser bushing comprising:

an axially extending electrical conductor; and first and second condenser elements, each formed of like electrically insulating material having a predetermined dielectric constant, coaxially disposed around said conductor, said first and second condenser elements being axially spaced apart to define a gap of predetermined width between adjacent end portions thereof, said gap being filled with an electrically insulating material having a predetermined dielectric constant, which dielectric constant is different than the dielectric constant of the electrically insulating material of said first and second condenser elements;

the end portion of said first condenser element which forms a part of said gap including first and second portions, said first portion being disposed at a predetermined obtuse angle with respect to the axis of the conductor and said second portion being disposed at a predetermined acute angle with respect to said axis of said conductor;

the end portion of said second condenser element which forms said other part of said gap including first and second portions, respectively aligned and spaced from said first and second portions of said first condenser element, said first portion of said second condenser element being disposed at a predetermined acute angle with respect to said axis of said conductor and said second portion of said second condenser element being disposed at a predetermined obtuse angle with respect to said axis of said conductor;

each of said first and second condenser elements including a plurality of concentric, axially extending, electrically conductive layers;

a portion of the electrically conductive layers in the first condenser element being disposed in proximity with the first portion of said end portion of said first condenser element, and a portion of the electrically conductive layers in the second condenser element being disposed in proximity with the second portion of said end portion of said second condenser element;

a portion of said electrically conductive layers disposed within said second portion of said first condenser element, and a portion of said electrically conductive layers disposed within said first portion of said second condenser element, having varying lengths so as to be incrementally spaced from said gap and said conductive layers at substantially the same potential in said adjacent condenser element so as to define a conductive layer free space.

* * * * *